US009168553B2

(12) United States Patent
Bellroth et al.

(10) Patent No.: US 9,168,553 B2
(45) Date of Patent: Oct. 27, 2015

(54) DEVICE FOR COLLECTING PAINT, LACQUER AND ADHESIVE RESIDUES OUT OF PAINT, LACQUER, AND ADHESIVE GUNS, PARTICULARLY GUNS CONNECTABLE TO A HOSE

(75) Inventors: Michael Bellroth, Lehrte (DE); Hans-Joachim Bödrich, Lehrte (DE)

(73) Assignee: B—TEC GmbH, Hannover (DE)

( * ) Notice: Subject to any disclaimer, the term of this patent is extended or adjusted under 35 U.S.C. 154(b) by 2 days.

(21) Appl. No.: 12/805,922

(22) Filed: Aug. 24, 2010

(65) Prior Publication Data

US 2011/0192424 A1 Aug. 11, 2011

(30) Foreign Application Priority Data

Feb. 5, 2010 (DE) ..... 10 2010 007 118

(51) Int. Cl.
*B05B 15/02* (2006.01)
*B44D 3/00* (2006.01)

(52) U.S. Cl.
CPC ..... *B05B 15/02* (2013.01); *B05B 15/025* (2013.01); *B44D 3/006* (2013.01)

(58) Field of Classification Search
CPC ..... B05B 15/025; B05B 15/02
See application file for complete search history.

(56) References Cited

U.S. PATENT DOCUMENTS

| | | | | |
|---|---|---|---|---|
| 3,771,539 | A | 11/1973 | De Santis | |
| 4,823,820 | A | 4/1989 | Larson et al. | |
| 5,855,218 | A * | 1/1999 | Giannetti | 134/102.1 |

FOREIGN PATENT DOCUMENTS

| | | | | |
|---|---|---|---|---|
| BE | 901795 | * | 6/1985 | |
| DE | 88 05 391.1 | U1 | 7/1988 | |
| DE | 10 2008 027 910 | A1 | 9/2009 | |
| GB | 2182266 | A * | 3/1986 | B05B 15/02 |
| JP | 40-1312830 | A * | 12/1989 | H01L 21/304 |

OTHER PUBLICATIONS

English machine translation of BE901795.*

* cited by examiner

*Primary Examiner* — Michael Barr
*Assistant Examiner* — Jason Riggleman
(74) *Attorney, Agent, or Firm* — Shlesinger, Arkwright & Garvey LLP

(57) ABSTRACT

Device for collecting paint, lacquer and adhesive residues out of paint, lacquer, and adhesive guns, in particular guns connectable to a hose. The device having a receptacle for collecting the residue, and the receptacle configured in such a way that during an interior rinsing of the guns using a rinsing flow for interior cleaning of the guns with a solvent, the degree of interior cleaning of the guns can be controlled optically by the user of the device. The indicator element for displaying the degree of interior cleaning may be made removable from the device. The device for collecting the residue out of paint, lacquer, and adhesive guns may likewise be used when the guns are connected to a hose.

8 Claims, 1 Drawing Sheet

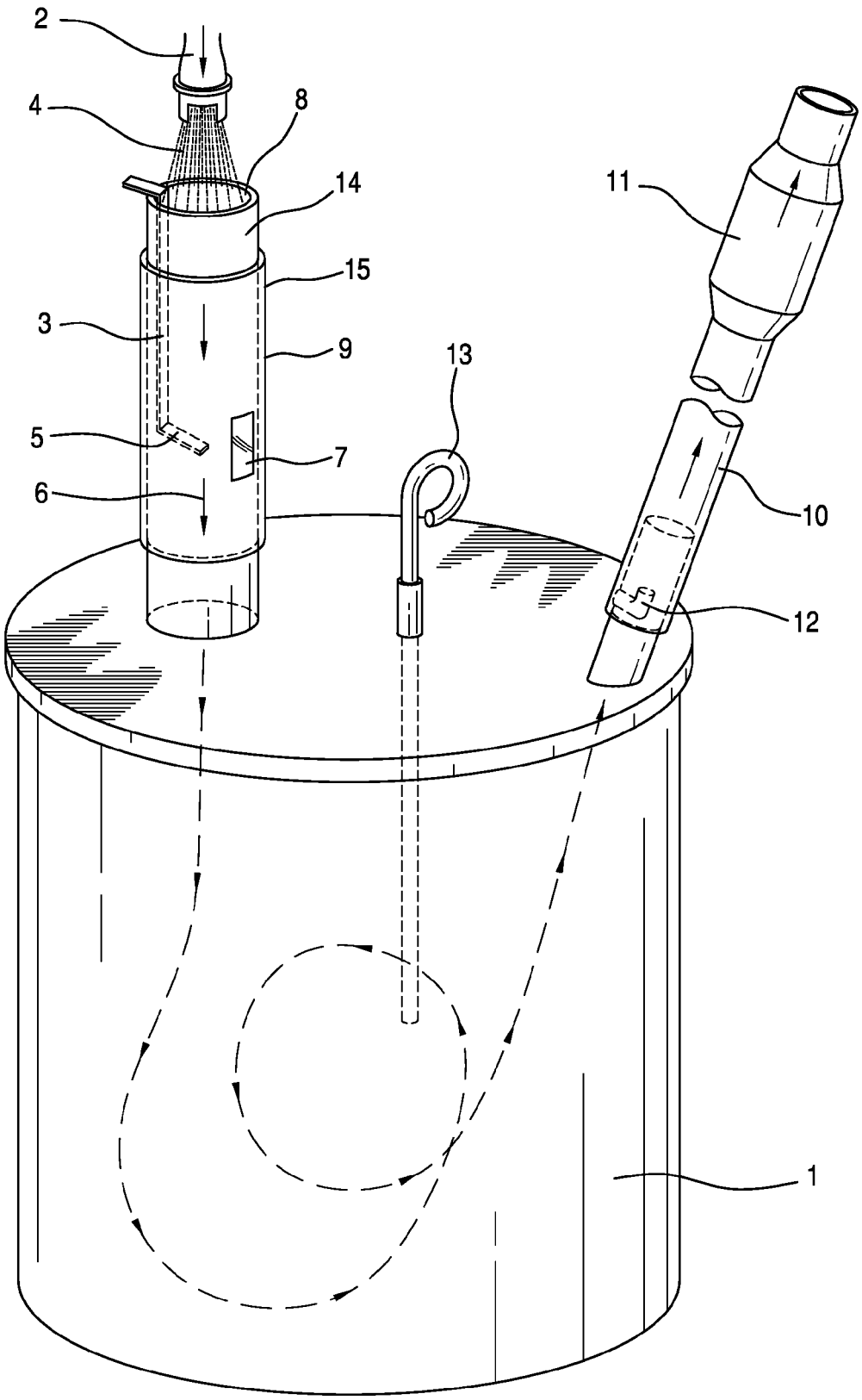
2
4
8
14
15
3
9
13
5
7
6
11
10
12
1

DEVICE FOR COLLECTING PAINT, LACQUER AND ADHESIVE RESIDUES OUT OF PAINT, LACQUER, AND ADHESIVE GUNS, PARTICULARLY GUNS CONNECTABLE TO A HOSE

CROSS-REFERENCE TO RELATED APPLICATIONS

This application claims the priority of German application no. 10 2010 007 118.8, filed Feb. 5, 2010, and which is incorporated herein by reference.

FIELD OF THE INVENTION

The invention relates to a device for collecting paint, lacquer and adhesive residue out of paint, lacquer and adhesive guns, in particular guns that are connected to a hose.

BACKGROUND OF THE INVENTION

U.S. Pat. No. 4,823,820 A makes known a device for collecting paint or lacquer residues out of paint spray guns that are connected to a hose with a receptacle for collecting the residues as well as their use, whereby the relationship is configured in such a way that during the interior rinsing of the gun by means of a rinsing flow for interior cleaning of the gun with the solvent, the degree of the interior cleaning can be optically controlled by means of a viewing window in the guns.

U.S. Pat. No. 3,771,539 A makes known in particular, a cleaning device for guns that are not connected to a hose, with which an exterior cleaning of the guns can be performed in a closed box-like receptacle that has a viewing window.

From G 88 05 391 U1 a canister-shaped or can-shaped receptacle for collecting the mixture discharged during cleaning of a paint spray gun consisting of paint and cleaning agent or solvent is known, with a collection opening that is open at the inner end and which continues at least partially into the interior space of the pipe section extending into the receptacle for the front end of the paint spray gun and a discharge opening for the discharge of air out of the receptacle, whereby the part of the pipe section that is located in the interior space of the receptacle has at least one lateral opening, whereby the outlet opening of the receptacle wall is provided at a distance from the wall section which has the collecting opening, and whereby the wall section facing the discharge opening of the pipe section is closed. A disadvantage of this embodiment is that no actual economical use of a solvent for rinsing the interior of the gun and thus for interior cleaning of the guns can be realized, because as a rule, only certain solvent quantities according to rough empirical values are indicated by a corresponding gun, in order to achieve a corresponding cleaning.

OBJECTS AND SUMMARY OF THE INVENTION

An object of the invention is to overcome the drawbacks of the prior art.

This object is achieved with a device according to the invention for collecting paint, lacquer and adhesive residues out of paint, lacquer, and adhesive guns connectable to a hose, including:

a) a receptacle provided for collecting paint, lacquer, and adhesive residue;

b) the receptacle being configured in such a way that during an interior rinsing of the gun by use of a rinsing flow for interior cleaning of the gun with a solvent, the degree of interior cleaning of the gun can be controlled optically; and c) an indicator element for displaying the degree of interior cleaning being provided, and the indicator element being removable from the device.

This and other objects are likewise achieved with a method according to the invention of using the device according to the invention set forth immediately above.

Additional objects and respective summaries of the invention are as follows.

The object of the present invention is therefore, to provide a device that is economical in this respect relative to the consumption of solvent. This object is achieved in accordance with the invention by a device for collecting paint, lacquer and adhesive residues out of paint, lacquer, and adhesive guns connectable to a hose, including:

a) a receptacle being provided for collecting paint, lacquer, and adhesive residue;

b) the receptacle being configured in such a way that during an interior rinsing of the gun by use of a rinsing 10 flow for interior cleaning of the gun with a solvent, the degree of interior cleaning of the gun can be controlled optically; and c) an indicator element for displaying the degree of interior cleaning being provided, and the indicator element being removable from the device, as well as a method of using such a device wherein the device is used for one of interior and exterior cleaning of paint, lacquer, and adhesive guns.

The device in accordance with the invention for collecting paint, lacquer and adhesive residues out of paint, lacquer and adhesive guns, in particular guns that are connected to a hose has, for example, and in particular a metal canister for collecting the residues. Beyond that, the receptacle is configured in such a way that during the interior rinsing of the gun by means of a rinsing flow of solvent, that is, a flow of solvent containing perhaps still-present paint, lacquer and adhesive residues for interior cleaning of the guns, the degree of the interior cleaning of the guns can be controlled optically.

The optical controllability can, for example, be accomplished in particular thereby, that an indicator element, for example a metallic strip that is located in the rinsing flow, and which includes an effective surface which extends transversely to the rinsing flow, so that paint, lacquer and adhesive residues that are still present, can partially precipitate there and that therefore upon removal, the degree of cleaning can be determined, indicating the degree of the interior cleansing during the interior rinsing of the guns by the rinsing flow.

It is in accordance with the invention when the indicator element, for example, and in particular the previously described metallic strip for indicating the degree of interior cleaning, can be removed from the device, in order to, after a certain time of rinsing of the guns, then perform an optical control as to how much paint, lacquer and adhesive residue is still in the interior of the guns that are to be cleaned, in order to then decide if an additional rinsing is warranted or not. This is particularly advisable in the case of unfavorable lighting conditions, in order to ensure high precision in terms of the assessment of the perhaps still to be removed residues.

In this context it is advantageous when the indicator element is of a metallic nature, for example, it consists of stainless steel, in order to prevent electrostatic charges from the outset and thus to minimize the danger of solvents which are, in part, highly flammable.

It is further advantageous when the indicator element has a strip-like configuration, as such can then be adapted to the geometric relationships present at the respective location, so that such can be located in the rinsing flow, in order to at least provide a certain effective surface which is at least partially aligned transversely to the actual rinsing flow direction, for example, aligned in a diagonal manner with respect to the rinsing flow.

It is therefore advantageous if the device according to the invention is provided with a surface that is at least partially aligned transversely to the direction of the rinsing flow, in order to thus ensure a possibility of an optical controllability in relation to the degree of cleaning.

Further, it is advantageous in this connection if the device in accordance with the invention has a viewing window, for example, and in particular, in the form of a glass for the optical control of the indicator element, in order to also perform an optical control of the degree of cleaning by use of the paint lacquer and adhesive residue adhering to the indicator element in individual cases during running operations or after stopping the rinsing without an actual removal of the indicator element out of the device in accordance with the invention.

In this connection it is further advantageous if the indicator element and/or the viewing window is/are located in a pipe-like section of the receptacle, whereby the rinsing flow passes through the pipe-like section during operation, whereby such is located for example, and in particular, above the receptacle in order to actually easily realize an optical control during operation.

As a rule, spray nozzles of spray guns have bores in the so-called vent caps that serve to select the degree of dispersion in order to realize a lacquer application that is as uniform as possible. The controllability according to the invention makes it possible to identify the irregularity of a degree of dispersion of a spray gun already during spraying, so that the user can, if necessary, clean jammed bores by opening them at this stage already.

Further, it is advantageous when the pipe-like section is designed double-walled, in order to minimize potential losses of pressure between the pipe-like section and the receptacle, and to thus provide, a quasi redundant material fixation between the pipe-like section and the receptacle, for example, by screwing the pipe-like section onto the receptacle or by means of welding the double-walled pipe-like section to the receptacle.

For longer and more controlled reduction of the overpressure caused by the introduction of the rinsing flow, it is advantageous, when an exhaust-pipe-like element is mounted on the receptacle, whereby in an advantageous manner, the length of the exhaust-pipe-like elements is at least 1 meter and beyond that, also in advantageous manner, the inner diameter of the exhaust-pipe-like element is in the range of 30 mm to 70 mm, in particular, approximately 60 mm, as, in practice, these dimensions have shown to be extremely advantageous relative to a controlled pressure compensation.

Beyond that, it is advantageous if the exhaust-pipe-like element is provided with an air filter, in order to, for example, hold back any remnants of the paint, lacquer and adhesive residues that were swept along, for example, and in particular, by means of filtering, in particular by using steel wool.

Further, it is advantageous when the exhaust-pipe-like element is provided with a so-called venturi nozzle to support ensuring the discharging of the overpressure air in the receptacle, based on the generally known Venturi Principle, as due to the slight underpressure of the exhaust gas (primarily air) flowing past the venturi nozzle from the environment, additional air is taken in, which in turn assures that air and solvent vapors are moved more controlled, and sometimes also faster out of the receptacle to the outside through the exhaust-pipe-like element.

Finally, it is advantageous when the device according to the invention includes an apparatus which is configured in such a way that guns that are connected to hoses can be cleaned, or are cleaned, from the inside and/or outside, whereby during the cleaning, the corresponding hoses remain connected to the guns, and the hoses lead out of the device. Concerning this, reference is made to the entire contents of the disclosure of published German Offenlegungsschrift DE 10 2008 027 910.

The invention shall be explained in greater detail in the following using the attached drawings of an embodiment. All of the features described, depicted in the drawings, and claimed in the patent claims, singly and in any combination with one another, form the subject-matter of the invention, regardless of their summary in the patent claims and references and regardless of their description or depiction, respectively, in the drawings:

BRIEF DESCRIPTION OF THE DRAWINGS

FIG. 1 is a front perspective view of an embodiment of a device for collecting paint, lacquer, and adhesive residues out of paint, lacquer, and adhesive guns, particularly guns connectable to a hose according to the invention.

DETAILED DESCRIPTION OF THE INVENTION

Moreover, the device in accordance with the invention is explained in further detail without any limitations, whereby in FIG. 1, in perspective view, an example of an embodiment of the device according to the invention is illustrated.

In FIG. 1, a device for collecting paint, lacquer and adhesive residues from paint, lacquer and adhesive guns, in particular guns that are connected to a hose, with a receptacle 1 for collecting the residues is shown. The receptacle 1 itself is a metallic vat made of stainless steel. In this case, a lacquer gun 2, which is indicated only schematically, is aligned from the top in the direction of an upper neck 8 of a pipe-like section 9, in order to then rinse out the remaining lacquer residues with a solvent, whereby the rinsing flow that is being created passes through the pipe-like section 9, in order to then subsequently be collected in receptacle 1. During the interior cleaning, i.e. during the rinsing with solvent, which flows through the interior of the lacquer gun, the lacquer residues that are to be removed flow with the solvent past a metallic, strip-like indicator element 3, whereby a part of the lacquer residue precipitates on a surface 5 of the indicator element 3, so that after stopping the rinsing stream 4, the indicator element 3 can be removed in order to perform an optical control for the purpose of how high the residue contamination of lacquer residues is in the interior of the lacquer gun 2, in order to then decide whether to clean further or if the degree of cleaning appears to be sufficient relative to the next application.

In the case of very conspicuous residues that are to be removed, such as paint residues, the strip-like indicator element 3 does not need to be especially removed in many cases, as then, by means of the viewing window element 7 consisting of glass, an optical control is possible during ongoing operation. The solvent that enters the receptacle 1 in rinsing flow direction 6 in addition to perhaps still present paint, lacquer and adhesive residues strikes a bottom of the receptacle 1 or already present residual solvent on the bottom, respectively, whereby as a rule, the paint, lacquer and adhesive residues settle, however, simultaneously due to entering the receptacle 1, and an overpressure builds up in the interior of the receptacle 1, that is then reduced by the outflow of the gases that are present, in particular air. The remainder of the paint, lacquer and adhesive residues that are carried along is then held back by an air filter 11 that is filled with steel wool, so that in the ideal case only air and some of the solvent are discharged or drained off in controlled manner. To speed up the increase of the build-up of pressure in receptacle 1, in the first lower third of the exhaust-pipe-like element 10, a venturi nozzle 12 is located, that generates an additional underpressure due to air flowing in from the outside below the venturi nozzle that ensures a faster pressure compensation in receptacle 1.

Still further, receptacle 1 contains a fill-level meter 13 that optically illustrates the interior fill level, so that the respective user can make a timely decision to change the receptacle 1 or to empty such.

Further, it can be seen that the pipe-like section 9 is provided double-walled, i.e. it has an inner pipe 14 and an outer pipe 15. The outer pipe 15 is for additional safety relating to possible losses in pressure, that could be created by leakages between the inner pipe 14 and the receptacle 1, as the outer pipe 15 is closed toward the top and toward the receptacle, it is firmly connected with the receptacle 1, so that in the event of potential leakages between inner pipe 14 and the receptacle 1, the loss of pressure compensates quickly and is limited only to the remaining volume which is created between the inner pipe and the outer pipe.

Only for the sake of good order let it be mentioned that it is also possible that the pipe-like section 9 is directly connected with an apparatus that is equipped in such a way that the guns that are connected to a hose can be cleaned, or are 20 cleaned, from the inside and/or outside, whereby the corresponding hoses remain connected to the guns during the cleaning and the hoses lead out of the device. Hereby, reference is made to the entire contents of the disclosure of laid-open DE 2008 027 910 A1. In such a case, a gun 2 that is to be cleaned would not be guided and aligned as illustrated, as it were, by hand to the upper neck 8 of the pipe-like section, in order to then guide the rinsing flow 4 through the pipe-like section 9, but the gun 2 to be cleaned would then, in the device of DE 10 2008 027 910 Al, be applied to the working volume there, in order to finally also perform an interior cleaning by means of rinsing the interior of the gun 2 to be cleaned with a solvent, whereby then via a hose located there, the rinsing flow would pass over a drainage of the device into the pipe-like section 9. This advantageous design is a design, by means of which the device according to the invention is, as it were, complemented by means of a corresponding device, as set forth in DE 10 2008 027 910 Al, the relevant parts of which have been incorporated herein.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. Device for collecting paint, lacquer and adhesive residues out of paint, lacquer, and adhesive guns connectable to a hose, comprising:

a) a receptacle being provided for collecting paint, lacquer, and adhesive residue;

b) the receptacle being configured in such a way that during an interior rinsing of the gun by use of a rinsing flow for interior cleaning of the gun with a solvent, the degree of interior cleaning of the gun can be controlled optically;

c) an indicator element for displaying the degree of interior cleaning being provided, and the indicator element being removable from the device;

d) the indicator element for displaying the degree of interior cleaning during the interior rinsing of the guns is located in the rinsing flow;

e) a viewing window element is provided for optical control of the indicator element;

f) the indicator element is located in a pipe section of the receptacle, and the viewing window element is located in the pipe section of the receptacle, so that the rinsing flow passing through the pipe section during operation is controllable optically via the window element; and g) the rinsing flow has a direction through the pipe section and toward the receptacle, and the indicator element is shaped for providing a surface which extends transversely with respect to the direction of the rinsing flow, and the surface being a surface on which residue precipitates and so that the residue is controllable optically by the user via the window element, so that the user can decide whether the degree of interior cleaning of the gun is sufficient or whether to clean further.

2. Device according to claim 1, wherein:

a) the indicator element is a strip indicator element.

3. Device according to claim 1, wherein:

a) the pipe section is designed double-walled.

4. Device according to claim 3, wherein:

a) an exhaust pipe element is mounted on the receptacle.

5. Device according to claim 4, wherein:

a) the length of the exhaust pipe element is at least one meter long.

6. Device according to claim 5, wherein:

a) the inner diameter of the exhaust pipe element is in the range of 30 mm to 70 mm.

7. Device according to claim 4, wherein:

a) the exhaust pipe element is provided with an air filter.

8. Device according to claim 4, wherein:

a) the exhaust pipe element is provided with a venturi nozzle.

* * * * *